United States Patent [19]

Tsuya et al.

[11] 4,265,682

[45] May 5, 1981

[54] HIGH SILICON STEEL THIN STRIPS AND A METHOD FOR PRODUCING THE SAME

[75] Inventors: Noboru Tsuya, 1-38, Kashiwagi 2-Chome, Sendai, Japan; Kenichi Arai, Sendai, Japan

[73] Assignee: Norboru Tsuya, Sendai, Japan

[21] Appl. No.: 974,506

[22] Filed: Dec. 29, 1978

[30] Foreign Application Priority Data

Sep. 19, 1978 [JP] Japan ..... 53/114847
Nov. 15, 1978 [JP] Japan ..... 53/141290

[51] Int. Cl.[3] ..... H01F 1/04

[52] U.S. Cl. ..... 148/112; 148/31.55; 164/423; 335/125; 335/297

[58] Field of Search ..... 148/111, 112, 31.55; 164/423, 429, 87; 335/297, 296; 360/125, 126, 127

[56] References Cited

U.S. PATENT DOCUMENTS

| | | | |
|---|---|---|---|
| 1,756,196 | 4/1930 | Hopkins et al. | 164/87 |
| 1,867,818 | 7/1932 | Freeland | 148/111 |
| 2,209,687 | 7/1940 | Crafts | 148/111 |
| 2,364,642 | 12/1944 | Miller et al. | 175/366 |
| 2,956,023 | 10/1960 | Fredrick et al. | 252/62.3 |
| 3,089,795 | 5/1963 | Hu | 148/111 |
| 3,144,363 | 8/1964 | Aspden et al. | 148/111 |
| 3,241,000 | 3/1966 | Dewald et al. | 317/234 |
| 3,381,739 | 5/1968 | Hart | 164/64 |
| 3,445,554 | 5/1969 | Jerome | 264/56 |
| 3,545,967 | 12/1970 | Mandal | 75/134 |
| 3,663,767 | 5/1972 | Shimotori et al. | 179/100.2 C |
| 3,748,728 | 7/1973 | Watson | 29/599 |
| 3,837,827 | 9/1974 | Carruthers et al. | 65/30 |
| 3,896,203 | 7/1975 | Maringer et al. | 264/165 |
| 3,902,930 | 9/1975 | Sata et al. | 148/112 |
| 4,000,014 | 12/1976 | Winter | 148/11.5 R |
| 4,049,522 | 9/1977 | Ainslie et al. | 360/126 |
| 4,065,330 | 12/1977 | Masumoto et al. | 148/31.55 |
| 4,079,430 | 3/1978 | Fujishima et al. | 360/126 |
| 4,135,218 | 1/1979 | Nakamura et al. | 360/127 |
| 4,146,391 | 3/1979 | Inoue et al. | 75/124 |

FOREIGN PATENT DOCUMENTS 51-138517 5/1976 Japan .

*Primary Examiner*—L. Dewayne Rutledge
*Assistant Examiner*—John P. Sheehan
*Attorney, Agent, or Firm*—Fleit & Jacobson

[57] ABSTRACT

A high silicon steel strip having excellent magnetic properties and good workability, and having a composition consisting of 4–10% by weight of silicon and the remainder being substantially iron and incidental impurities is produced by cooling super rapidly the high silicon steel melt on a cooling substrate to form a thin strip having micro-structure comprising very fine crystal grains having substantially no ordered lattice.

15 Claims, 15 Drawing Figures

100 μm

100 μm

HIGH SILICON STEEL THIN STRIPS AND A METHOD FOR PRODUCING THE SAME

The present invention relates to high silicon steel thin strips containing 4–10% of silicon and a method for producing the same.

Silicon steel sheet containing about 3% of silicon has been broadly used as an iron core material of electric apparatus such as transformer. These silicon steel sheets are usually classified into non-oriented silicon steel sheets wherein the direction of the crystal axis of crystal grains is randomly distributed and oriented silicon steel sheets wherein [100] axis of crystal grains is aligned in the rolling direction. The former is mainly used for the iron core material of rotary machines and generators in which the magnetic flux is applied in various directions, and the latter is used for that of transformer and the like in which the flux is applied in only one direction. In these applications, the most strongly demanded point is firstly the reduction of iron loss of the material up to the level as low as possible. It is supposed that this becomes more strongly required because of increase of the energy cost. Secondly the noise of apparatus due to the magnetostriction of material is required as low as possible. It is considered that this demand will also become more strong. In order to comply with these demands, in the non-oriented silicon steel, such technics have been effectively developed as to decrease incidentally remaining impurities such as carbon, nitrogen, oxygen, sulfur and the like which deteriorate the iron loss, as little as possible and as to aligne [100] axis on the sheet surface plane. On the other hand, in the oriented silicon steel, some technical developments have recently been attained; for example, alignment of [100] axis in the rolling direction to a higher degree and applying tension in the steel by coating resulting in the reduction of iron loss and apparent magnetostriction.

However, the conventional technic for producing silicon steel sheet has been improved so highly that the magentic property and the magnetostrictive property of the today's conventional products seem to be at the level of saturation point, and so it is supposed that, even if a great effort is made, the obtainable improvement of the magentic property is slight.

It is known from 1950's that high silicon steel containing about 6.5% of silicon, though its saturation magnetic flux density is as low as 1.8T, has negligibly small magnetostriction and the magnetic anisotropy reduced half as compared with conventional 3% silicon steel, and that such a high silicon steel shows more excellent soft magnetism (high permeability and low coercive force) than 3% silicon steel. When the transformer is constructed with this material, the iron loss is also expected very low at the proper exciting magnetic flux density and further the noise is also expected not substantially caused. Therefore, this material is very attractive in the actual application. When the silicon content exceeds about 4%, however, the material becomes very brittle due to the hardening of Si itself and the formation of ordered lattices ($Fe_3Si$). Therefore, not only the commercial production is substantially impossible due to the absolute difficult rolling, but also shearing and punching of the product become infeasible. Under such a circumstance, these steels have never been commercially produced, in spite of the fact that high silicon steels containing more than 4% of silicon, particularly about 6.5% of silicon, have excellent magnetic properties.

The present inventors have found that thin strips, obtained by cooling molten silicon steel containing 4–10% silicon super rapidly, have very fine crystal grain structure substantially without ordered lattices, and satisfactorily good flexibility and workability and the excellent magnetic property. Based on these findings and further studies, the present invention has been completed.

The present invention will be explained in more detail referring to the accompanying drawings.

FIGS. 1(A), (B) and 1(C), (D) show the photomicrographs of the surface and the cross-section of 6.4% silicon steel thin strip as super rapidly cooled and as annealed, respectively.

Figure 4A:
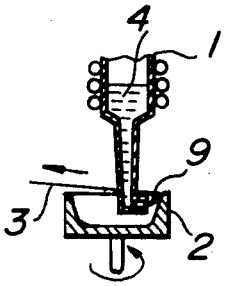
Figure 5:
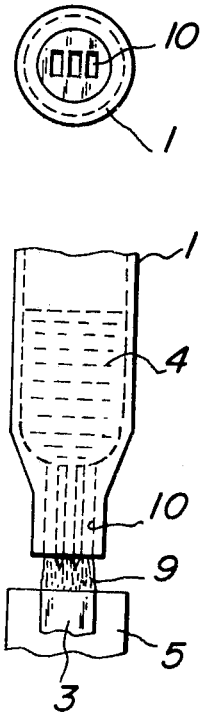
Figure 6:
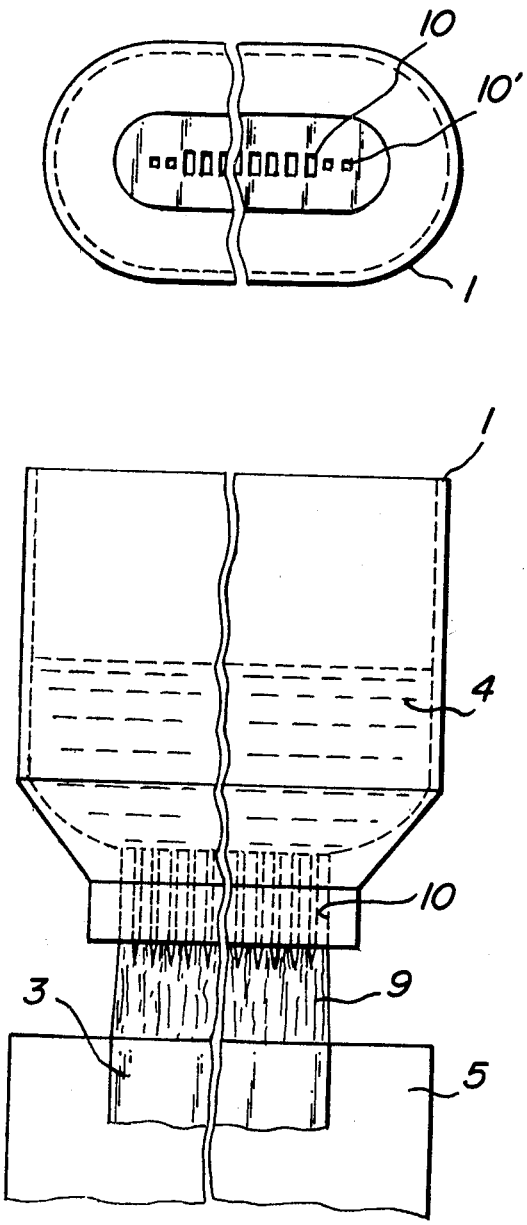
Figure 7:
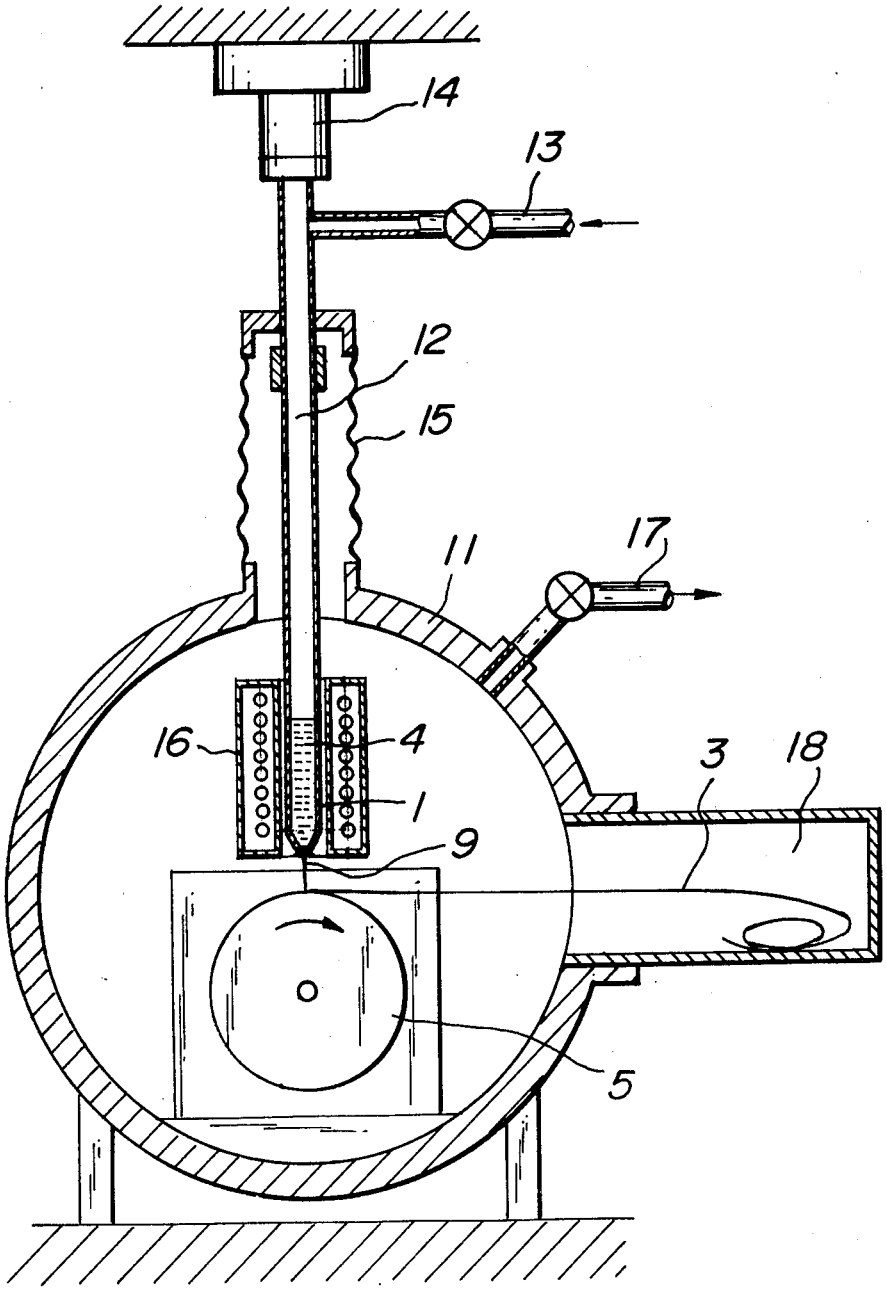
Figure 8:
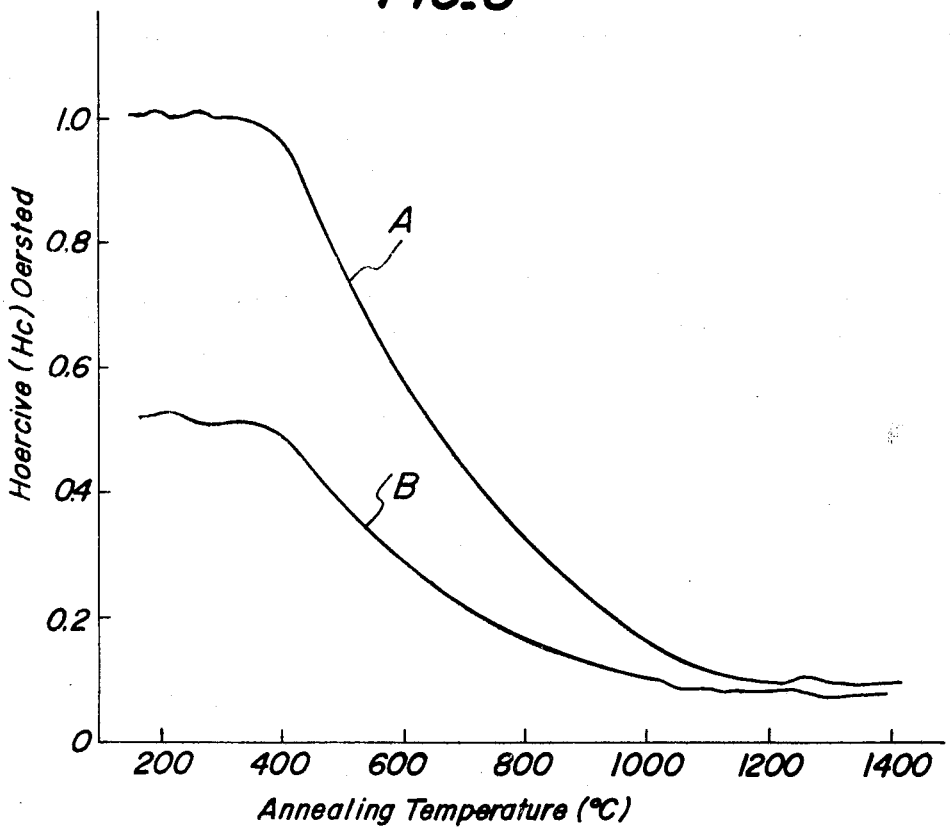
Figure 9:
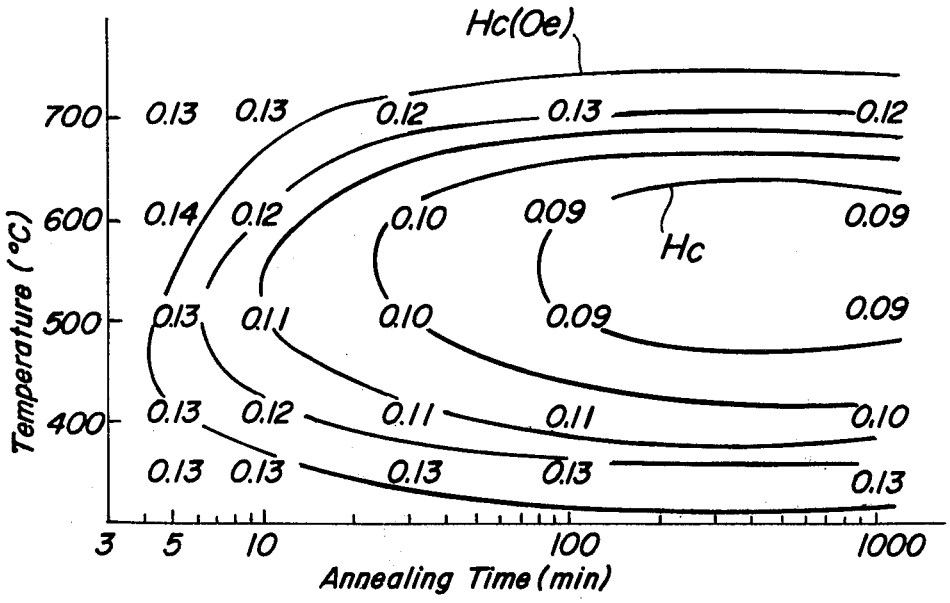

FIGS. 4(A), (B), (C) and (D) are schematic views of embodiments for producing the silicon steel strip of the present invention;

FIG. 5 and FIG. 6 are the front views and end views of embodiment of multi-hole nozzles for producing the silicon steel thin strips of the present invention respectively;

FIG. 7 is an explaining diagrammatical view of an embodiment for producing the silicon steel strip of the present invention;

FIG. 8 shows the results obtained when a thin strip (A) of 6.5% Si-Fe having an average grain diameter of 5 μm and a thickness of 80 μm and a thin strip (B) having the same composition as described above and an average grain diameter of 15 μm and a thickness of 80 μm are annealed at various temperatures for 2 minutes; and FIG. 9 is a diagrammatical view showing the relation of the heat treatment temperature, heat treatment time and the coercive force (Hc) of the silicon steel thin strips of the present invention.

Figure 1A:
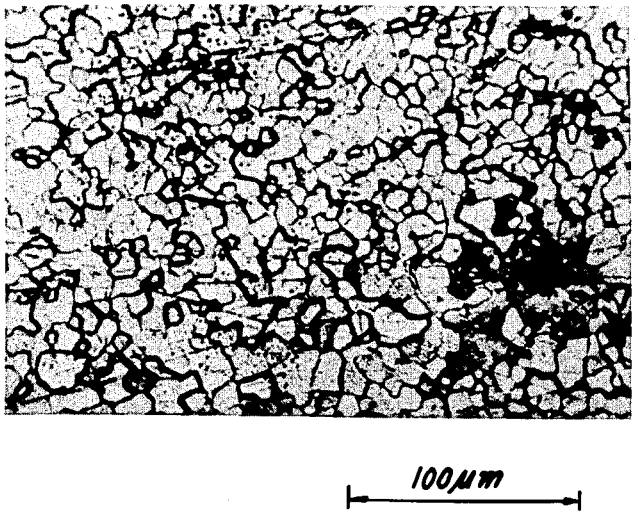
Figure 1B:
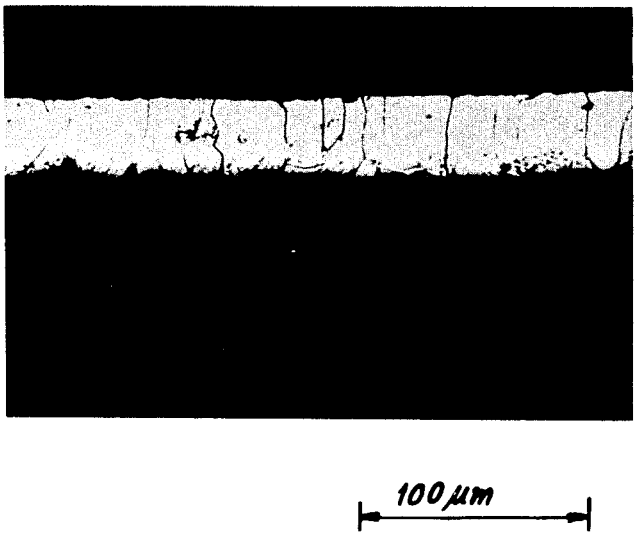
Figure 2:
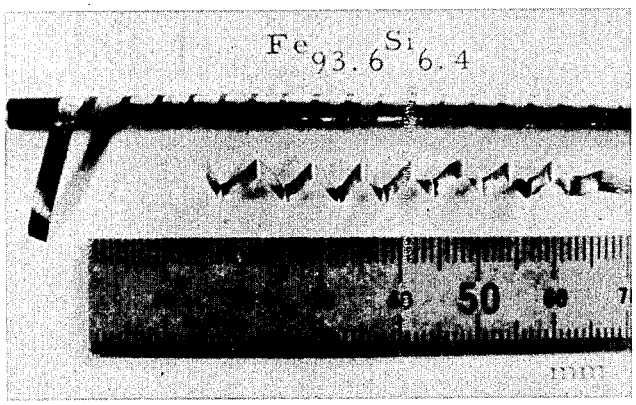
FIG. 2 shows the thin strip wrapped both around a rod having a diameter of 4 mm and bent.

FIGS. 1(A) and (B) show an embodiment of photomicrographs of 6.5% Si-Fe silicon steel thin strip of the present invention. FIG. 1(A) shows the photomicrograph of the surface of the thin strip obtained by cooling super rapidly and FIG. 1(B) shows the photomicrograph of the cross-section thereof. From these photomicrographs it can be seen that the crystal grains having a diameter of about 5–10 μm are oriented in the perpendicular direction against the surface of the thin strip. FIG. 2 shows the flexible workability of the same silicon steel thin strip, the state when the thin strip of the present invention is wrapped around a rod having a diameter of 4 mm and the bending state. As seen from FIG. 2, said thin strip can be bent to such an extent which has never been heretofore supposed to be feasible.

Figure 3:
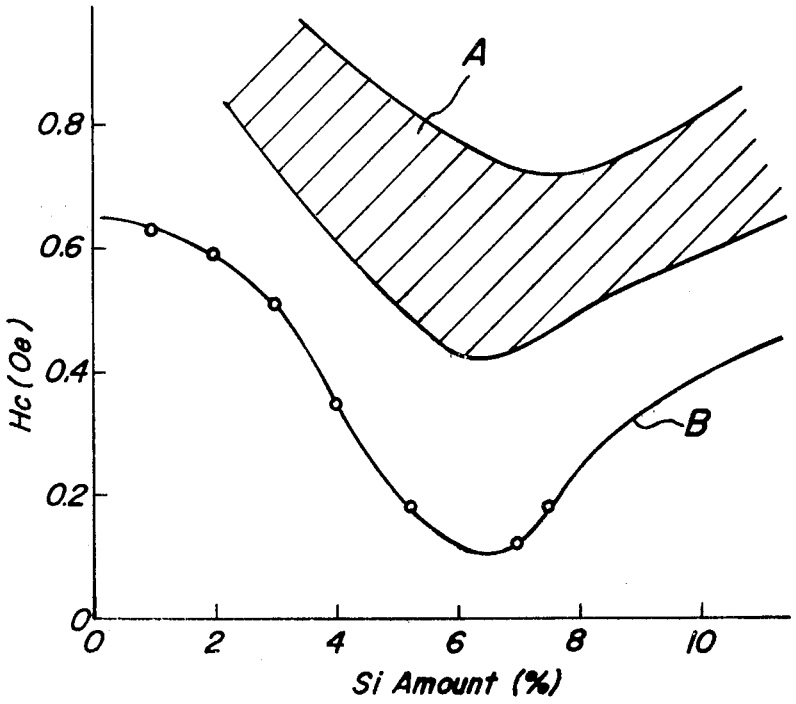
FIG. 3 shows the coercive force, Hc, of the silicon steel thin strips consisting of 3–11% Si and the remainder of iron substantially, which is prepared by super cooling at the quenching rate of $10^{3°}$–$10^{4°}$C./sec (curve A), as compared with those of the high silicon steel (curve B) which is prepared conventionally.

FIG. 3 shows the comparison of the coercive forces (Hc) (curve A) when the thin strips obtained by super rapidly cooling the molten steels containing various contents of 3–11% of Si and the remainder being Fe at a rate of $10^{3°}$–$10^{4°}$C./sec, are magnetized up to 10 KG with that (curve B) of a high silicon steel produced by the conventional process. As seen from FIG. 3, in the thin strip of the present invention, Hc gradually decreases in the high silicon region in the same manner as in the conventional high silicon steel and in the vicinity of 6.5% of silicon, and it shows the same grade of Hc as in the conventional 3% silicon steel.

Although the thin strip, super rapidly cooled from the molten state, has larger Hc than the conventional silicon steel, the values of Hc can be improved by annealing as mentioned hereinafter up to the level of the conventional high silicon steel.

The good workability of the high silicon steel of the present invention results from the fine crystal grain structure as shown in FIGS. 1(A) and (B) and the absence of ordered lattice. When the diameter of the crystal grains exceeds 100 μm in the super rapidly cooled state, the workability is deteriorated. It is not preferable in commercial production. On the other hand, even when such material is prepared as having fine grains with diameters less than 1 μm, the further improvement of the workability is not substantially obtained, whereas a cooling at a too high rate is needed resulting in a poor economical production.

When the silicon steel thin strip obtained by the method of the present invention is heat-treated, the crystal grains become coarse and the magnetic property (Hc) is noticeably improved. This situation is explained by showing the photomicrographs of FIGS. 1(C) and (D) as follows.

Figure 1C:
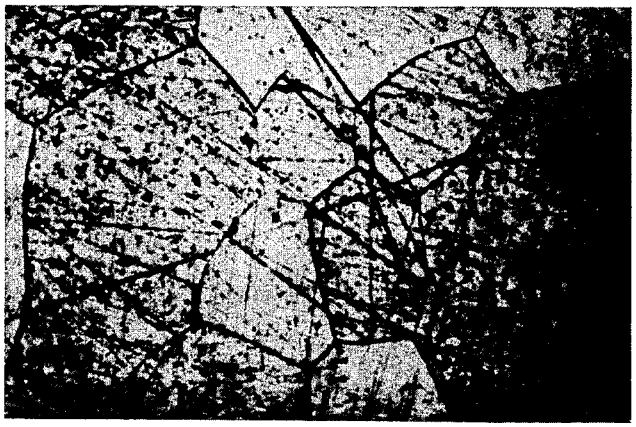

FIGS. 1(C) and (D) show the photomicrographs of the surface structure and the cross-sectional structure, respectively, of the silicon steel strip (6.4% Si-Fe) annealed at 1,200° C. for 40 minutes in an argon atmosphere. The crystal grain shown in the photographs is remarkedly coarsened due to the grain growth during annealing and the diameter exceeds 150 μm. The grain diameter of the crystals of the thin strip depends upon the period and temperature of the annealing. As the crystal grain of the thin strip becomes coarse, the magnetic property (Hc) is noticeably improved.

Figure 1D:
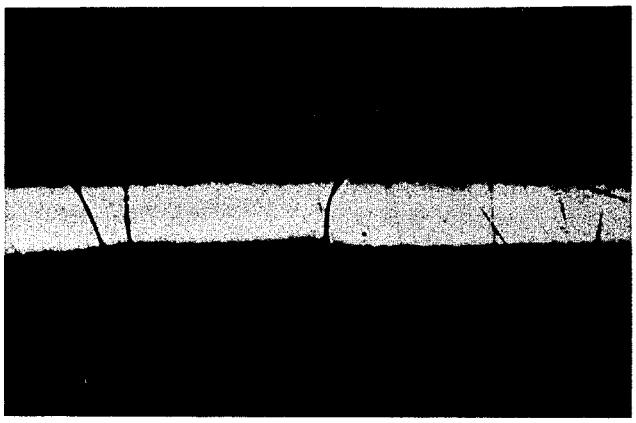

Even after the above described heat treatment, the thin strip has the satisfactory workability. This reason is presumably attributed to the facts that the crystal grains grow preferably in the direction normal to the strip surface as shown in the photomicrograph of FIG. 1(D) and that ordered lattice is not substantially present.

Then, an explanation will be made with respect to the composition.

The high silicon steel thin strip of the present invention, in general, contains 4–10% of silicon, the remainder being substantially iron and the incidental impurities.

When silicon content is less than 4%, the magnetic property is not more excellent than that of the conventional product, while, when silicon exceeds 10%, the silicon steel strip becomes brittle and the magnetic property obtained becomes poorer. The silicon content of 5–7% is preferred, because the best magnetic properties are obtained at this range. In silicon steel, impurities such as oxygen, sulfur, carbon and nitrogen are included incidentally. When they remain in the final products these impurities deteriorate the iron loss and make the thin strip brittle to deteriorate the workability, so that it is desirable to restrain the content of these impurities small. When the total amount of these impurities exceeds 0.1%, the iron loss becomes larger than that of the conventional silicon steel. Accordingly, the upper limit of silicon content must be 0.1%. In the present steelmaking technic, it is possible to get oxygen less than 50 ppm, sulfur less than 80 ppm, carbon less than 100 ppm and nitrogen less than 50 ppm, and it is particularly preferable to make the impurities within this range.

In the composition of the present invention, less than 2% of Al and less than 2% of Mn can be added. As Al is more strong deoxidizing element than Si, the material having lower oxygen content can be obtained through the addition of Al. Furthermore, it increases the electric resistivity and is preferable in view of lowering the eddy-current loss. However, Al increases the magnetostriction, so that the addition of more than 2% Al is not preferable and the upper limit is set 2%. Mn is contained in an amount of about 0.05% in conventional steelmaking as an incidental impure element. It is known that this element, different from oxygen and sulfur, and is rather preferable for the rolling ability and the magnetic properties. Also, it is recognized in the present invention, that the addition of less than 2%, preferably 0.2–1.3% of Mn not only improves the magnetic properties, but also provides the thin silicon strip having a good appearance (that is; there is no void and crack at the width end). The reason of this phenomenon is currently not clear, but the sulfur is supposed to form a large precipitate of MnS from the solid solution state or the fine precipitate state resulting in better rolling ability and the magnetic properties. However, when Mn content becomes more than 2%, the magnetic properties are rather deteriorated and moreover such a silicon steel thin strip hardens, so that the workability of the product becomes poor. Accordingly, the maximum content is limited to 2%.

The thin strip of the present invention contains high content of silicon. Therefore, it has a defect that the saturation magnetic flux density necessarily becomes low. When Co is added to Fe-Si alloy, the saturation magnetic flux density becomes high. In the present invention, if necessary, Co can be added to compensate the above described defect. However, Co is the very expensive element, so that in the present invention, the upper limit of Co is set 10%. Ni is an element which increases the toughness in Fe-Si alloy, and it has been found that the addition of nickel of less than 3%, preferably 0.2–1.5% can provide the super rapidly cooled thin strip having a good quality.

Even if the elements other than the above described elements, such as Cr, Mo, W, Va, Ti, Sn and the like are contained in a total amount of less than about 0.1% as impurities, the effect of the present invention is not prevented.

In the production of the conventional silicon steel sheet, an ingot or a continuous casting slab is hot rolled to obtain a hot strip having a thickness of 1.5–4 mm and then proper cold rolling and heat treatments are combined to produce the final product having a thickness of 0.28–0.50 mm. In the present invention, on the other hand the molten silicon steel having the above described composition is directly super rapidly cooled and immediately finished to the thin strip having a given thickness. That is, the final product or the semi-final product is directly produced from the molten silicon steel and the hot rolling step and the cold rolling step which are inevitable in the conventional method, are completely eliminated. The method for producing the thin strip by super rapidly cooling the molten steel can include any process, provided that the thin strip having the satisfactory width and a given even thickness can be continuously obtained in a coil-form by said process. Typically, as shown in FIGS. 4 and 5, the molten steel 4 is continuously ejected from hole(s) having the proper configuration onto a continuously moving substrate and super rapidly cooled and solidified to obtain a strip having a given thickness in a coil-form.

FIG. 4(A) is a schematic view of an apparatus for producing a continuous thin strip 3 wherein a molten steel 4 is ejected from a nozzle 1 onto an inner surface of the cup-shaped rotator.

Figure 4B:
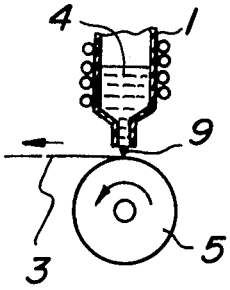
Figure 4C:
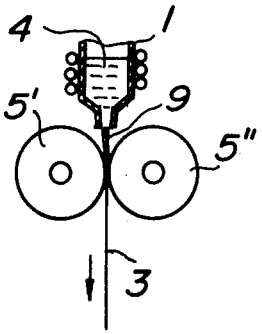

FIGS. 4(B) and (C) show schematic views of apparatus for producing continuous thin strips wherein the molten silicon steel 4 is continuously ejected from the nozzle onto a single rotating roll or between two adjacent rotating rolls 5' and 5" which have not necessarily the same diameter.

Figure 4D:
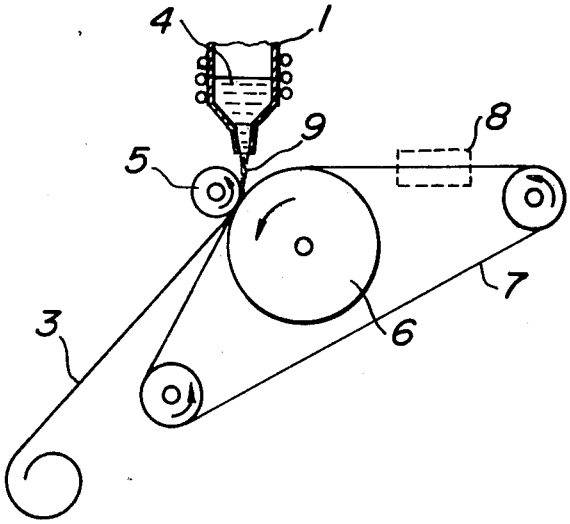

FIG. 4(D) shows a schematic view of an apparatus for producing a continuous thin strip wherein the molten silicon steel 4 is supplied between an endless metal conveyor belt 7 and a rotating roll 5. In FIG. 4(D), the numeral 8 shows an apparatus for cooling the conveyor 7.

In the case where the silicon steel thin strip is produced by using the above described apparatus, it is important that the melt is cooled and solidified at a sufficiently high speed. Firstly, when the time needed from ejection to the contact of the melt with the moving substrate is long, the flow of the ejected melt and solidification becomes divergent and presumably such strips are apt to be obtained as having holes and voids and occasionally uneven thickness place to place. In that case, especially in air atmosphere, the thin strip is subjected to oxidation or nitrogenation and the thin strip having a good shape can not be obtained or even if desirable, the product contains oxygen or nitrogen deteriorating the magnetic property. On the other hand, in cases that it takes a long time for the thin strips from the solidification to cooling up to 400° C., at which the crystal grain growth and the formation of ordered lattices do not occur any more, the resulting thin strip has partially ordered lattice and coarsened crystal grains and then the succeeding shearing and punching or rolling, if necessary, become difficult. Based on various experiments by varying the rotation speed of the rotator and the ejecting pressure on the melt, the inventors have found that when the average cooling rate from ejection of the melt until cooling of solidified thin strip up to 400° C. is less than $10^3$°C./sec, the desirable thin strip can not be obtained. When the production is effected at a lower rate than the said critical cooling rate, oxidation occurs and continuous good shaped thin strip can not be obtained, or, even if such a thin strip can be obtained, the thin strip is very brittle. It is practically preferable in economical production to cool the melt to 400° C. at a cooling rate of $10^{3°}$–$10^{6°}$C./sec in order to obtain the thin strip which has satisfactorily fine crystal grains and substantially ordered lattice.

Commercially, the high silicon thin strip with satisfactorily large width must be produced according to the present invention. In general, the slit-shaped nozzle having the necessary width can be used, but in order to obtain the thin strip having an even thickness along the whole width the use of a nozzle 1 is preferable as shown in FIGS. 5 and 6 wherein two or more ejecting slits 10 are arranged adjacently on one line along the whole width. In this case, if supplementary ejecting slits 10' are provided at the end portion of the nozzle, the ejected melt flow 9 becomes more plane-shaped along the width direction. Accordingly, the thin strip having the even thickness can be obtained by such a means.

In order to commercially produce a high silicon steel continuous thin strip, it is necessary to continuously eject the melt from the nozzle over long period of time. In this circumstance the nozzle is damaged considerably. The nozzle is generally made of a refractory material having a high melting point, such as boron nitride ceramics. In this case, if the surround of nozzle is continuously cooled with water, liquid metal or gas in order to prevent the damage, the durable life of the nozzle is considerably extended.

Furthermore, in order to accurately prevent the oxidation and nitrogenation obtaining the thin strip with few impurities, the whole apparatus for producing the thin strip is put in a chamber under a protective gas atmosphere or vacuum as shown in FIG. 7. In addition, it is preferable that argon gas, helium gas or $CO_2$ gas is blown to the vicinity of the nozzle as a protective gas.

FIG. 7 shows an apparatus for producing the silicon steel thin strip of the present invention under vacuum. A rotating cooling roll 5 made of a substance with high thermal conductivity for example, cooper, is arranged in the vacuum chamber 11 and is connected to a motor for driving the roll. Just above the roll 5, a nozzle 1 charging a high silicon steel material is arranged so as to be movable upward and downward. The high silicon steel raw material is fed into the nozzle 1 through a tube 12. A gas is forcedly fed into the tube 12 through a tube 13 in order to eject the high silicon steel raw material from the nozzle 1. The numeral 14 represents a cylinder, which displaces the nozzle 1 upward and downward to adjust the distance between the nozzle 1 and the rotating roll 5. The numeral 15 represents a vacuum bellows, which expands and contracts freely depending upon the up-and-down displacement of the nozzle 1 and seals between the vacuum chamber 11 and the nozzle 1. A heater 16 is arranged arround the tip of the nozzle 1 for heating the nozzle 1 to a temperature of, for example, 1,400°–1,600° C. to melt the high silicon steel raw material charged in the nozzle 1. The numeral 17 represents an outlet tube of the vacuum chamber 11 and is connected to an vacuum system. The numeral 18 represents an opening for collecting a silicon steel thin strip.

When a molten high silicon steel raw material is ejected from the nozzle 1 and cooled super rapidly on the rotating surface of the rotating roll 5, the interior of the vacuum chamber 11 can be also kept under a natural atomosphere, or under a protective atmosphere, such as Ar, $N_2$ and the like.

In the above described device for producing the silicon steel thin strip shown in FIGS. 4–7, it is important to select the material of the rotating cooling substrate by taking the wettability between the cooling substrate and the silicon steel into account. When the temperature of the silicon steel melt is 300° C. higher than the melting point, the viscosity of the melt becomes low. In this case, such troubles occur occasionally that the melt oozes out from the nozzle during the heating, or the jet flow of the ejected melt is spread widely divergent just like mist over the surface of the rotating cooling substrate, resulting in a too thin or a rattan blind-like strip.

When the temperature of the melt is too low, the jet flow of the ejected melt can not creep closely along on the surface of the rotating cooling substrate owing to the high viscosity of the melt and the melt can not be cooled very rapidly. In such cases, also, the object of the present invention can not be attained.

Further, when the ejection pressure upon a melt from the nozzle is too high, the jet flow of the ejected melt scatters away in the form of fine particles having irregular configuration.

Accordingly, in the present invention, it is necessary to select properly the viscosity of a melt so that the ejected melt is deposited on the surface of the rotating cooling substrate at a contact angle of 10°–170°, preferably subtantially 90°, with respect to the substrate surface. For this purpose, the temperature of the melt is preferred to be 100°–150° C. higher than the melting point of the silicon steel.

In the present invention, the melt should be ejected through the nozzle under a pressure within the range of 0.01–1.5 atm. The reason is as follows. When the ejection pressure upon the melt is too high, the ejected melt scatters in the form of mist or fine particles, and formed into a rattan blind-like strip according to the viscosity of the melt.

To be mentioned additionally when the ejection of the melt is carried out under vacuum, the above described drawbacks can be eliminated. That is, as no collision occurs between the ejected melt with air, the formation of rattan blind-like strip, and the formation of fine splits in the edge portion of the resulting strip are eliminated as well as the formation of porous strip.

By the above described method, the high silicon steel thin strip wound in a coil-form is immediately produced from the melt. The crystal grain of the thin strip thus produced is very fine with usually 1–100 μm diameter.

Such a thin strip has already a good shape and magnetic properties that can be directly used as the final product. In order to develop the higher magnetic properties, the thin strip is annealed at 400°–1,300° C., preferably 800°–1,250° C. for a short time, generally from 10 minutes to 5 hours to remove the inner strain and concurrently to grow the grain diameter up to 0.05–10 mm. When this treatment is carried out, the coercive force, for example, is extremely improved. When this annealing temperature exceeds 1,300° C., the thin strip becomes brittle and can not be practically used. When the temperature is lower than 400° C., it is impossible to remove the inner strain. This heat treatment may be effected in any method but it is preferable commercially to effect the annealing for about 60 seconds in the continuous annealing furnace followed by cooling as rapid as possible.

FIG. 8 shows the relation between the coercive force and the annealing temperature where the thin strip A (6.5% Si-Fe) having an average grain diameter of 5 μm and a thickness of 80 μm and the thin strip B (same composition as A) having an average grain diameter of 15 μm and a thickness of 80 μm are annealed at various temperatures for 2 minutes. As the result of the annealing, at a temperature of higher than 400° C., the decrease of Hc is observed with decrease of temperature, and this tendency is saturated at a temperature of 1,300° C.

In practical construction of an iron core, in general, it is demanded to enhance the space factor of the iron core as high as possible. For the purpose, the surface of the thin strip must be flattened smooth. In the present invention, the super rapidly cooled and solidified thin strip shows a satisfactorily smooth surface provided that the production conditions are proper chosen. When the higher smoothness is required, the super rapidly cooled and solidified thin strip is subjected to heat treatment, if necessary and then rolled at a reduction rate of more than 5% and finally annealed under the above described conditions. The rolling can be satisfactorily effected by a usual cold rolling machine, but when silicon amount is as high as 7–10% and there appears a fear of occurence of crack in the rolling, it is recommended to effect the rolling at a temperature of 100°–500° C. Furthermore, the proper rolling and annealing improve magnetic properties. This reason is not clear, but this is presumably because the strip texture is varied by the rolling and heat treatment.

The produced thin strip, as mentioned above, is utilized as iron core for electric apparatus, such as transformer and rotary machine. In this case, when the laminated iron core, as such, is annealed to form ordered lattice in the thin strip, Hc is found to decrease greatly. In this case, the brittleness caused by the formation of the ordered lattice makes no hindrance in practice because of the annealing after lamination.

FIG. 9 shows the variation of Hc of the thin strip (6.5% Si, 0.2% Mn, the remainder being Fe) obtained by annealing said strip at 1,200° C. for 3 minutes and then maintaining at 350°–700° C. for various periods. As seen from this data, the good results are obtained when the annealing is effected at 400°–650° C. for more than 30 minutes. Accordingly, it is preferable that the above described annealing in the iron core state is effected within this temperature range.

The following examples are given for the purpose of illustration of this invention and are not intended as limitations thereof.

EXAMPLE 1

A molten steel containing 6.5% of silicon, 0.6% of manganese, 0.3% of aluminum and further containing 0.007% of carbon, 0.004% of nitrogen, 0.003% of oxygen and 0.005% of sulfur as incidental impurities was ejected on a rotating cooling substrate made of copper and having a diameter of 300 mm, which was rotated at a rate of 800 rpm, to produce a thin strip having a thickness of 80 μm. The thin strip was annealed at 1,200° C., for 3 minutes, rolled into a thickness of 65 μm, and annealed at 1,000° C. for 3 minutes. Finally, the annealed strip was wound up into a coil, and then annealed at 500° C. for 3 hours. The magnetic property (Hc) and workability of the thin strip after each of the above described treatments are shown in the following Table 1.

TABLE 1

| Thin strip | Hc (Oe) | Minimum radius of curvature (mm) | Shear property |
|---|---|---|---|
| After super rapid cooling | 0.70 | <1.0 | o |
| After annealing at 1,200° C. for 3 min. | 0.15 | 1.0 | o |
| After rolling and annealing at 1,000° C. for 3 min. | 0.13 | 1.0 | o |
| After annealing at 500° C. for 3 hrs. | 0.09 | 3.0 | Δ |

In the above Table 1, the magnetic property (Hc) is measured at 1.5T magnetization. The minimum radius of curvature means the minimum diameter of glass rod, on which the strip can be wound around without breaking. The shear property is classified as follows.

o—There is no shear cracks, and the strip has a good shear property

Δ—There are some shear cracks, but the strip can be shorn.

x—Shearing of the strip is difficult.

EXAMPLE 2

A molten silicon steel containing 9.5% of silicon, 1.5% of manganese, 2% of cobalt, 0.1% of aluminum and 0.7% of nickel and further containing 0.004% of carbon, 0.0025% of nitrogen, 0.0023% of oxygen and 0.003% of sulfur as incidental impurities was ejected on a pair of rotating substrates made of stainless steel with a diameter of 100 mm, which were rotated at a rate of 700 rpm, to produce a thin strip having a thickness of 100 μm. The thin strip was immediately rolled into a thickness of 50 μm and then annealed at 950° C. for 2 minutes. The annealed strip was further annealed at 420° C. for 10 hours. The magnetic property and workability of the thin strip after each of the above described treatments are shown in the following Table 2.

TABLE 2

| Thin strip | Hc (Oe) | Minimum radius of curvature (mm) | Shear property |
|---|---|---|---|
| After super rapid cooling | 0.80 | <1.0 | o |
| After rolling and annealing at 950° C. for 2 min. | 0.43 | 3.0 | Δ |
| After annealing at 420° C. for 10 hrs. | 0.31 | 6.0 | x |

The measuring conditions of the properties in the above Table 2 are the same as those in Example 1.

According to the present invention, a very ductile and flexible high silicon steel thin strip can be continuously produced in a high production speed, and further the resulting high silicon steel thin strip can be easily worked as well as rolled and heat-treated.

Moreover, according to the present invention, it is possible to produce a laminated iron core with improved magnetic property by forming ordered lattice by means of annealing core materials after working and construction. Therefore, the present invention is very useful for industry.

What is claimed is:

1. A method of producing a thin strip of high silicon steel having excellent magnetic properties and good workability comprising the combination of steps of:

preparing a high silicon steel melt having a composition consisting essentially of 4–10% by weight of silicon, less than about 2% of aluminum and the remainder being iron and incidental impurities, cooling the melt to about 400° C. on a cooling substrate at a cooling rate of from about $10^3$ to $10^6$°C./sec. to form a thin strip having micro-structure comprising very fine crystal grains without ordered lattics of $Fe_3Si$.

2. A method as defined in claim 1, wherein the composition of said melt consists essentially of 4–7% by weight of silicon and in percent by weight at least one element selected from the group consisting of less than 2% of manganese, less than 10% of cobalt, and less than 3% of nickel the remainder being iron and incidental impurities.

3. A method as defined in claim 1, wherein the melt is cooled by ejecting the melt onto a moving surface of cooling substrate.

4. A method as defined in claim 3, wherein the melt is ejected through a nozzle having a plurality of nozzle holes arranged adjacent to each other in the lateral direction of a thin strip.

5. A method as defined in claim 4, wherein the melt is ejected under vacuum or protective atmosphere selected from the group consisting of argon, nitrogen, carbon dioxide or mixture thereof.

6. A method of producing a thin strip of high silicon steel having excellent magnetic properties and good workability comprising the steps of:

preparing a high silicon steel melt having a composition consisting essentially of 4–10% by weight of silicon less than about 2% of aluminum and the remainder being iron and incidental impurities, cooling the melt to about 400° C. on a cooling substrate at a cooling rate of from about $10^3$ to $10^6$°C./sec. to form a thin strip having micro-structure consisting of very fine crystal grains without ordered lattices of $Fe_3Si$, subjecting the thus obtained strip to further annealing at a temperature of 400°–1,300° C. for 1 minute to 5 hours so as to promote the grain growth to 0.05–10 mm.

7. A method of producing a thin strip of high silicon steel having excellent magnetic properties and good workability comprising the steps of:

preparing a high silicon steel melt having a composition consisting essentially of 4–10% by weight of silicon, less than about 2% of aluminum and the remainder being iron and incidental impurities, cooling the melt to about 400° C. on a cooling substrate at a cooling rate of from about $10^3$ to $10^6$°C./sec. to form a thin strip having micro-structure consisting of very fine crystal grains without ordered lattices of $Fe_3Si$, wherein the thus obtained strip is further rolled at least at a reduction rate of 5%, and annealed at a temperature of 400°–1,300° C. for 10 minutes to 5 hours.

8. The method of claim 1, wherein the melt of high silicon steel is maintained at a temperature of from its melting point to a temperature 300° C. higher than its melting point to control melt viscosity.

9. A thin strip of high silicon steel having excellent magnetic properties and good workability, having composition consisting essentially of by weight 4–10% of silicon, less than about 2% of aluminum and the remainder being iron and incidental impurities and having a micro-structure consisting of very fine crystal grains without ordered lattices of $Fe_3Si$, wherein the fine crystal grains are essentially columnar grains aligned in a direction perpendicular to the surface of the thin strip and have a mean grain diameter of from about 1–100 μm.

10. A thin strip as defined in claim 9, which also includes in percent by weight at least one element selected from the group consisting of less than 2% of manganese, less than 10% of cobalt, and less than 3% of nickel.

11. A thin strip as defined in claim 9, wherein said incidental impurities are less than 0.1% in total of carbon, nitrogen, oxygen and sulfur.

12. A thin strip as defined in claim 9, wherein the silicon is present in an amount of from about 5–7% by weight.

13. A thin strip of high silicon steel having excellent magnetic properties and good workability, having a composition consisting essentially of 4–10% by weight of silicon, less than about 2% of aluminum and the remainder being iron and incidental impurities and having a micro-structure consisting of very fine grains having a mean grain diameter of 0.05–10 mm, which is obtained by annealing a thin strip having a micro-structure consisting of very fine grains without ordered lattices of $Fe_3Si$.

14. A core for electrical devices manufactured by laminating thin high silicon electrical steel sheets having a composition consisting essentially of 4–10% by weight of silicon, less than about 2% aluminum and the remainder being iron and incidental impurities and having a micro-structure comprising very fine crystal grains without lattices of $Fe_3Si$, wherein the fine crystal grains are essentially columnar grains aligned in a direction perpendicular to the surface of the thin strip and have a mean grain diameter of from about 1–100 μm.

15. A core as defined in claim 14, wherein the core is annealed at a temperature of 400°–650° C. for 10 minutes to 5 hours so as to form an ordered lattice in the crystal grains.

* * * * *